US009265687B2

(12) United States Patent
Ahlbertz et al.

(10) Patent No.: US 9,265,687 B2
(45) Date of Patent: Feb. 23, 2016

(54) RISING SUPPORT INTEGRATED IN A WALKING AID

(75) Inventors: Anders Ahlbertz, Vastra Frolunda (SE); Johan Gladh, Falkenberg (SE)

(73) Assignee: Gate Rehab Development AB, Isaberga Sateri Smalandsstenar (SE)

( * ) Notice: Subject to any disclaimer, the term of this patent is extended or adjusted under 35 U.S.C. 154(b) by 318 days.

(21) Appl. No.: 13/805,438

(22) PCT Filed: Jun. 20, 2011

(86) PCT No.: PCT/SE2011/050795

§ 371 (c)(1), (2), (4) Date: Dec. 19, 2012

(87) PCT Pub. No.: WO2011/162697

PCT Pub. Date: Dec. 29, 2011

(65) Prior Publication Data

US 2013/0098413 A1 Apr. 25, 2013

(30) Foreign Application Priority Data

Jun. 23, 2010 (SE) ..... 1050670

(51) Int. Cl.

| | |
|---|---|
| ***A63B 21/00*** | (2006.01) |
| ***A61H 3/00*** | (2006.01) |
| ***A61G 7/10*** | (2006.01) |
| ***A61H 3/04*** | (2006.01) |

(52) U.S. Cl.

CPC ..... *A61H 3/00* (2013.01); *A61G 7/1019* (2013.01); *A61G 7/1051* (2013.01); *A61H 3/04* (2013.01); *A61G 7/1046* (2013.01); *A61H 2003/005* (2013.01); *A61H 2003/006* (2013.01); *A61H 2003/046* (2013.01); *A61H 2201/1207* (2013.01); *A61H 2201/1409* (2013.01); *A61H 2201/1635* (2013.01); *A61H 2201/1652* (2013.01); *A61H 2201/5007* (2013.01)

(58) Field of Classification Search

USPC ..... 482/66–69

See application file for complete search history.

(56) References Cited

U.S. PATENT DOCUMENTS

| | | | | |
|---|---|---|---|---|
| 2,327,671 | A * | 8/1943 | Rupprecht | 280/87.021 |
| 2,625,202 | A | 1/1953 | Richardson et al. | |
| 3,778,052 | A * | 12/1973 | Andow et al. | 280/87.041 |
| 4,510,956 | A * | 4/1985 | King | 482/68 |
| 4,748,994 | A * | 6/1988 | Schultz et al. | 135/67 |

(Continued)

FOREIGN PATENT DOCUMENTS

| | | |
|---|---|---|
| JP | 2009066194 | 4/2009 |
| WO | 2007138175 | 12/2001 |
| WO | 03062038 | 7/2003 |

(Continued)

*Primary Examiner* — Jerome W Donnelly

(74) *Attorney, Agent, or Firm* — James Ray & Assoc.

(57) ABSTRACT

The invention provides a rising support integrated in a walking aid and a method of connecting a sling or harness to the walking aid. The walking aid has one part which is adjustable in height in relation to the rest of the walking aid. One or more traction devices, in the form of wires, are connected to the walking aid. One end of each traction device is fastened to the sling, while the other end of the traction device is fastened to a fixed part of the walking aid. Each traction device goes via the part adjustable in height. A person placed in the sling will be raised by the traction devices when the part adjustable in height is lifted, in that the traction device is fastened to the sling and a fixed part of the walking aid and that the traction device passes the part adjustable in height.

20 Claims, 2 Drawing Sheets

(56) References Cited

U.S. PATENT DOCUMENTS 5,526,893 A * 6/1996 Higer ..... 180/65.1
5,704,882 A * 1/1998 Coates et al. ..... 482/69
5,816,983 A * 10/1998 Dawes et al. ..... 482/78
6,311,708 B1 * 11/2001 Howle ..... 135/67

FOREIGN PATENT DOCUMENTS

WO 2010027313 3/2010

* cited by examiner

RISING SUPPORT INTEGRATED IN A WALKING AID

CROSS-REFERENCE TO RELATED APPLICATIONS

This is a national phase application claiming benefit of a prior PCT application. No. PCT/SE2011/050795 filed on Jun. 20, 2011, currently pending, published under PCT Article 21(2) in English as WO 2011/162697 A1 on Dec. 29, 2011, claiming priority to a Swedish patent application. No. 1050670-7 filed on Jun. 23, 2010 and having a common inventor with the prior PCT application.

TECHNICAL FIELD

The present invention concerns a rising support integrated in a walking aid.

PRIOR ART

For persons needing assistance in walking several different types of walking aids are available. One such kind of walking aid is called a walking table. A walking table has pads on an armrest platform, and handles in front of the pads. The walking table has a frame on four wheels and the height of the armrest platform in relation to the frame is adjustable. Thus, the armrest platform is vertically adjustable. In many embodiments the adjustment of the height of the armrest platform is power-actuated. In use the forearms of the person is to rest on the pads while the person grasps the handles.

Many persons does not have the leg power to rise themselves to a standing position, even though they are capable of walking with the support of a walking aid. There exists a number of different rising aids today, which are used for aiding persons in rising from a sitting position to a standing position and vice versa. Ward personnel or relatives are normally assisting a person needing help to rise to a standing position, with or without the use of a rising aid. Some persons may be able to rise themselves with the support of a power-actuated vertically adjustable part of a walking aid. However, other persons will need further assistance to be able to rise to a standing position.

There are walking tables and other walking aids of several different types. The present invention is possible to arrange at most walking aids having a part that is vertically adjustable.

SUMMARY

One object of the present invention is to use existing height adjustment of a walking aid to give a rising support for a person. By using existing functions of the walking aid a relatively inexpensive solution is given. Furthermore, the need of a separate rising aid is removed to a large extent.

According to the present invention a rising support is integrated in a walking aid, giving a means of automatically assisting a person rising from a sitting position to a standing position at the walking aid. The power-actuated height adjustment is used to help a person to rise to a standing position. The person is placed in a sling or harness and by arranging traction devices, such as wires, bands, ropes or chains in a suitable way the person is automatically risen to a standing position, by means of the movement at height adjustment.

It is relatively easy to adapt existing walking aids to use the present invention. Normally, the only adjustment to an existing walking aid having a vertically adjustable part is to arrange one or more traction devices in a suitable way. In addition to the adjustments of the walking aid only a sling or harness and one or more traction devices are to be supplied.

Further objects and advantages of the present invention will be obvious to a person skilled in the art reading the detailed description below of embodiments of the invention.

BRIEF DESCRIPTION OF THE DRAWINGS

The invention will be described further below, by way of example and with reference to the enclosed drawings. In the drawings.

DETAILED DESCRIPTION

Figure 1:
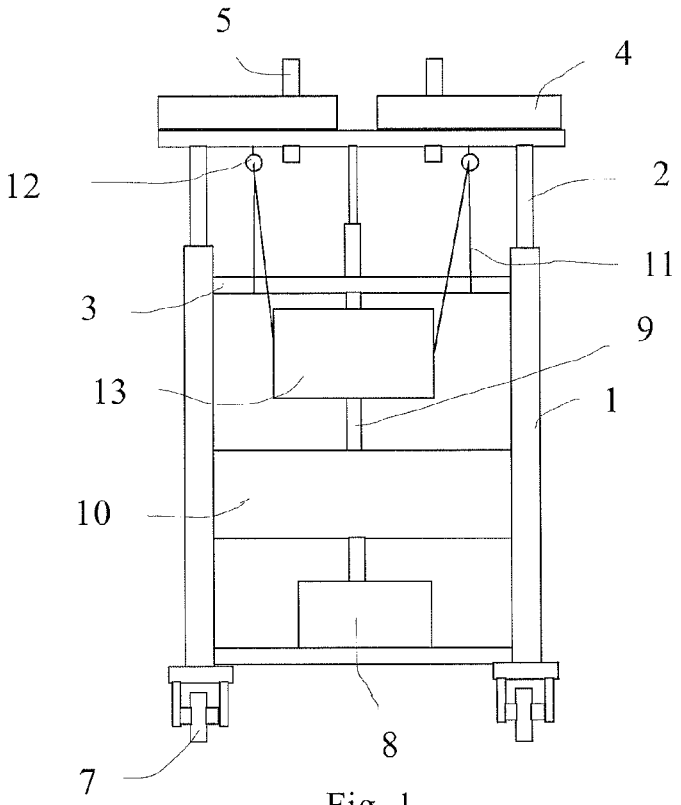
FIG. 1 is a view from behind of one example of a walking aid in the form of a walking table.

As used in this description the expressions "upper", "lower", "rear" and similar expressions are in view of a walking aid in normal use and as shown in the enclosed Fig(s).

The invention is described in connection with one type of walking table, but a person skilled in the art realises that the walking aid may have many different designs. However, the walking aid should have at least two parts that are adjustable in height in relation to each other. Normally a first part will be fixed while a second part is adjustable in height in relation to the first part. Thus, the walking aid should have a vertically adjustable part.

The shown walking table has a frame comprising two lower frame posts 1. The lower frame posts 1 are tubular. Upper frame posts 2 are received inside the tubular lower frame posts 1. The upper frame posts 2 are free to move in longitudinal direction inside the lower frame posts 1. As indicated above the form and number of frame posts may vary. Thus, in other embodiments the frame posts are not circular but having other cross section forms. In some embodiments there is only one column having a lower and upper part supporting the height adjustment, while in still further embodiments there are more than two co-operating lower and upper posts. A crossbar 3 is placed between the lower frame posts 1 at an upper part of the lower frame posts 1. On top of the upper frame posts 2 an armrest platform 4 is placed, having pads. The position of the pads may be adjusted. In one example the armrest platform 4 has a forward part and two rear parts at each side. As indicated by line 15 in FIG. 2 the rear parts of the armrest platform 4, i.e. the parts facing the person using the walking table, may be turned away outwards in the horizontal plane of the armrest platform 4. By turning away the rear parts of the armrest platform 4 the rising and lowering of the person may be facilitated. Handles 5 are placed in front of the armrest platform 4, which handles are to be grasped by the person using the walking table. A person skilled in the art realises that the handles 5 may be placed in many different positions in relation to the armrest platform 4.

At the lower part of the frame two wheel stands 6 are arranged having two wheels 7 each. The wheels 7 are placed at opposite ends of each wheel stand 6 and the rear wheel of each wheel stand 6 has normally a foot manoeuvred brake. The wheel stands 6 are placed at a distance from each other, to allow a person walking space between the wheel stands 6. On the lower part of the frame a motor and control unit 8 is placed. In some embodiments the positions of the wheel stands 6 are adjustable by means of the motor and control unit 8.

By means of the motor and control unit 8 the position of an actuator 9 is controlled. In the shown embodiment the actuator 9 is driven by an electric motor supported by a battery. A person skilled in the art realises that the actuator 9 may be driven in many different ways, as for example pneumatically, hydraulically or by means of gas. Often an actuator in the form of a gas cylinder is used. In some cases the height of the moveable part is adjusted manually. The actuator 9 rises and lowers the armrest platform 4 in relation to the frame. In the lowering and rising of the armrest platform 4, the upper frame posts 2 move inside the lower frame posts 1.

Below the crossbar 3 a knee support 10 is arranged between the two lower frame posts 1. The knee support 10 is normally padded. In one embodiment the knee support has the form of two distinct knee supports placed on one frame post 1 each, which knee supports may be turned to the side when walking. The purpose of the knee support 10 is explained further below. In some embodiments there are no knee supports.

Furthermore, the shown walking table has two traction devices in the form of wires 11, each having one end fastened in the crossbar 3. In other embodiments the traction devices has the form of ropes, bands, chains or the like. In the shown embodiment the wires 11 have snap hooks for the fastening to the crossbar 3. From the crossbar 3 the wires 11 goes through a loop 12 each, which loops 12 are placed on the lower side of the armrest platform 4. In other embodiments the loops are replaced by hooks, rings etc. The loops, hooks, rings etc. may be placed at any part of the vertically adjustable part. From the loops 12 the wires 11 go to a harness or sling 13, in which harness or sling 13 one end of each wire is releasably fastened, such as by means of a snap hook. A person skilled in the art realizes that the wires may be fastened to the crossbar 3 and the sling 13, respectively, in many different ways. Furthermore, the traction devices may be fixed to other portions of the fixed part of the walking aid than the crossbar. Alternatively, the traction devices may run on top of a crossbar or the like of a moveable part of the walking aid, in which case there are no loops, hooks, rings etc. Even though two wires are shown in the Figs., in other embodiments other numbers of traction devices are used. It is for instance possible to use only one traction device, which traction device may be split into two or more parts at the ends.

In some embodiments the traction devices are attached to a gearing, whereby the force and speed of the rising movement may be adjusted. The gearing comprises a number of gear wheels.

Figure 2:
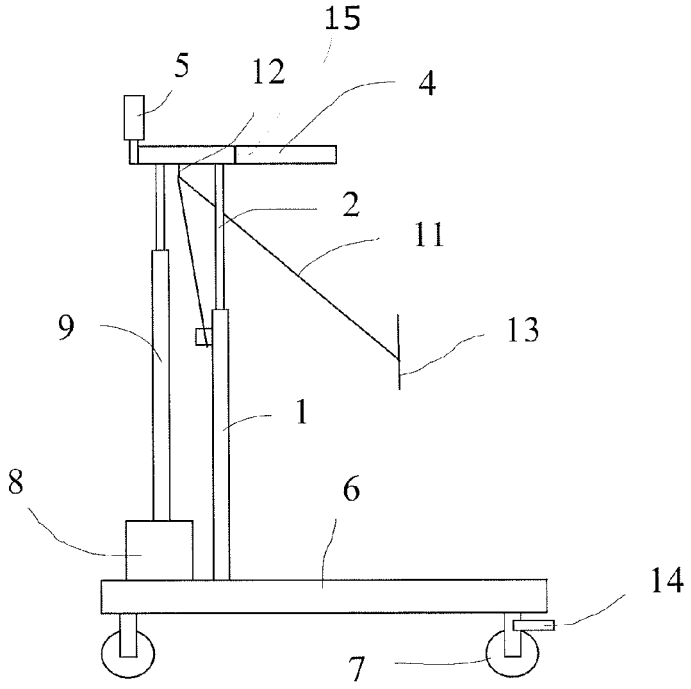
FIG. 2 is a side view of the walking table of FIG. 1

In aiding a person to rise from a sitting position to a standing position, the armrest platform 4 of the walking table as shown in FIGS. 1 and 2 is placed at a lowered position by means of the actuator 9 and the brakes of the rear wheels 7 are activated. With the armrest platform 4 in the lowered position the person to be risen is placed in the sling 13 and with the knees against the knee support 10, placed below the crossbar 3 of the frame. If needed the knee supports are turned to a proper position to assist the person to be risen. Then the wires 11 are fastened to the sling 13. Furthermore, the person placed in the sling 13 grips the handles 5, whereby the rear parts of the armrest platform 4 are turned away, if possible, to not hinder the rising movement. With the armrest platform 4 in a lowered position a large part of each wire 11 is placed between the loop 12 and the sling 13. As the armrest platform 4 is raised by means of the actuator 9 the length of the wires 11 placed between the loops 12 and the sling 13 decreases. Thereby the sling 13 is forced in direction towards the walking table. As the person placed in the sling 13 has his/her knees against the knee support 10 that person is automatically risen in that the distance between the sling 13 and the walking table is decreased. The person is also supported in the rising movement by means of the armrest platform 4 being lifted. When the person is in a standing position the movement of the armrest platform 4 is stopped. If applicable the rear parts of the armrest platform 4 are then turned back toward the centre to support the forearms of the person using the walking table. If two distinct knee supports are used, they are turned away not to impede walking. The brakes may then be released in order for the person to start walking with the aid of the walking table.

For movement from a standing position to a sitting position the above line of actions are reversed. Thus, first the brakes of the walking table are activated, with the walking table in a proper position in front of a chair or any other sitting facility. If applicable the rear parts of the armrest platform 4 are turned away and the knee supports are turned into position. Then the armrest platform 4 is lowered, until the person in the sling 13 is in a sitting position. The wires are then disconnected from the sling and the person is relived of the sling 13.

Figure 3:
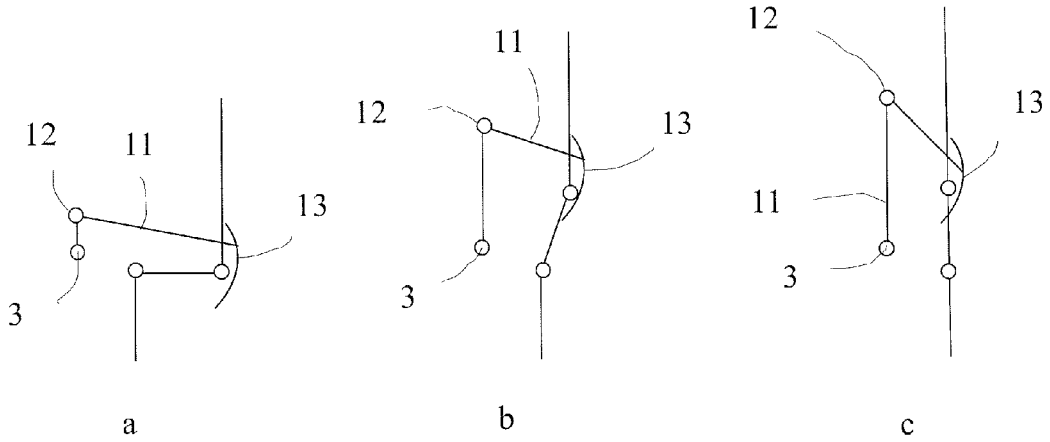
FIG. 3 is a sketch illustrating rising from a sitting position to a standing position of a person and by use of one embodiment of the present invention.

In the sketch of FIG. 3 the function of the walking table of FIGS. 1 and 2 is shown schematically. At a in FIG. 3 a person is indicated in a sitting position. In that position the armrest platform 4 is in a relatively low position and the length of each wire 11 between the crossbar 3 and the loop 12 is much less than between the loop 12 and the sling 13. At b in FIG. 3 the person is shown somewhere between sitting and standing positions and in that position the length of each wire 11 between the crossbar 3 and the loop 12 is increased at the same time as the length of each wire 11 between the loop 12 and the sling 13 is decreased. As stated above, this is achieved in that the armrest platform is being raised by means of the actuator 9, and that the wires 11 pass through respective loops 12 in the armrest platform 4. At c in FIG. 3 the person is indicated in a risen position, whereby the length of the wire 11 has increased further between the crossbar 3 and the loop 12 and decreased further between the loop 12 and the sling 13. With other embodiments the movements may be different from the schematic showing in FIG. 3. One example of another movement is if a gearing is used for the wires etc.

The sling 13 may have any form giving a support in the movement of rising a person from a sitting position to a standing position. The walking table may have many designs as long as it has parts moveable in relation to each other.

The invention claimed is:

1. A walking aid comprising a frame, a motor and control unit, at least one knee support, an integrated rising support including a part adjustable in height in relation to the frame, an actuator connected to the part adjustable in height, one or more traction devices selected from a group consisting of wires, bands, ropes or chains, to be fastened to a sling, whereby one end of each traction device is fastened to the sling, other end of the each traction device is fastened to a fixed part of the walking aid, the fixed part not influenced by any lifting movement, and the each traction device goes via the part adjustable in height, and wherein the part adjustable in height includes an armrest platform placed on top of the part adjustable in height, wherein the integrated rising support rises when a person placed into the sling is moved from a sitting position into a standing position.

2. The walking aid of claim 1, wherein the one or more traction devices are arranged to be moveable in relation to the part adjustable in height.

3. The walking aid of claim 2, wherein the one or more traction devices go over and slide on top of a portion of the part moveable in height.

4. The walking aid of claim 2, wherein the one or more traction devices go through one or more hooks, loops or rings on a part of the part adjustable in height.

5. The walking aid of claim 1, wherein the one or more traction devices are connected to a gearing.

6. The walking aid of claim 1, wherein the other end of each traction device is fastened to a crossbar, being a part of the frame of the walking aid, wherein the frame has lower frame posts being tubular and wherein upper frame posts are received moveable in a longitudinal direction inside the lower frame posts and wherein the armrest platform is placed on top of the upper frame posts.

7. The walking aid of claim 6, wherein rear parts of the armrest platform may be turned away.

8. The walking aid of claim 6, wherein the one or more traction devices go from the crossbar through loops, placed on the lower side of the armrest platform.

9. The walking aid of claim 1, wherein a snap hook is arranged on at least one end of the each traction device.

10. The walking aid of claim 1, wherein an actuator is connected to the part adjustable in height and to a motor and control unit.

11. The walking aid of claim 1, wherein the frame includes stationary lower frame posts and wherein at least one knee support is placed between the lower frame posts.

12. A walking aid comprising a frame, a part adjustable in height in relation to the frame, one or more traction devices, a sling, whereby one end of each traction device is fastened to the sling and other end of the each traction device is fastened to a fixed part of the walking aid, the fixed part not influenced by any lifting movement, and the each traction device goes via the part adjustable in height, wherein the part adjustable in height includes an armrest platform placed on top of the part adjustable in height, and wherein the armrest platform rises when a person placed into the sling is moved from a sitting position into a standing position.

13. A walking aid comprising:

a frame having a part not influenced by any lifting movement, a sling, a part adjustable in height in relation to the frame, the part adjustable in height having an armrest platform placed on top thereof, an actuator having one end thereof attached to the frame and having the other end thereof attached to the part adjustable in height, whereby the actuator raises and lowers the armrest platform in relation to the frame, a motor and control unit placed on a lower part of the frame and controlling the actuator, and one or more traction devices having one end thereof fastened to the sling and having other end thereof fastened to a part of the frame not influenced by any lifting movement, wherein the one or more traction devices go via the part adjustable in height.

14. The walking aid of claim 13, wherein the one or more traction devices includes bands, ropes or chains.

15. The walking aid of claim 13, further comprising a knee support attached to the part of the frame not influenced by any lifting movement.

16. The walking aid of claim 15, wherein the part of the frame not influenced by any lifting movement includes two frame posts and wherein the knee support includes two distinct knee supports, each placed onto a respective frame post.

17. The walking aid of claim 16, wherein the each distinct knee support is turnable to one side.

18. The walking aid of claim 13, further comprising at least one knee support arranged between the lower frame posts and handles attached to the armrest platform, and wherein the armrest platform and the one or more traction devices are operable to move a person placed into the sling from a sitting position into a standing position when the person grips the handles and rests knees against the at least one knee support.

19. The walking aid of claim 13, wherein the part not influenced by any lifting movement includes lower frame posts and wherein the part adjustable in height in relation to the frame further having upper frame posts that are free to move in a longitudinal vertical direction inside the lower frame posts during use of the walking aid.

20. The walking aid of claim 13, wherein one or more traction devices includes two traction devices.

* * * * *